US006702500B1

(12) United States Patent
Haffner et al.

(10) Patent No.: US 6,702,500 B1
(45) Date of Patent: Mar. 9, 2004

(54) WRITING INSTRUMENT WITH COMBINATION POCKET CLIP AND STYLUS ASSEMBLY

(75) Inventors: Kenneth Haffner, Miami Beach, FL (US); Gordon Perry, New York, NY (US)

(73) Assignee: Chartpak Inc., Leeds, MA (US)

( * ) Notice: Subject to any disclaimer, the term of this patent is extended or adjusted under 35 U.S.C. 154(b) by 0 days.

(21) Appl. No.: 10/315,888

(22) Filed: Dec. 10, 2002

(51) Int. Cl.[7] ..... B43K 1/10
(52) U.S. Cl. ..... 401/258; 401/195
(58) Field of Search ..... 401/258, 259, 401/260, 195, 131; 7/170; 345/179

(56) References Cited

U.S. PATENT DOCUMENTS

| | | | | |
|---|---|---|---|---|
| 1,124,651 A | | 1/1915 | Peterson | |
| 1,598,427 A | | 8/1926 | Easton | |
| 2,382,206 A | | 8/1945 | Compton | |
| 2,577,078 A | * | 12/1951 | Fried | 401/195 |
| 3,246,875 A | | 4/1966 | Hart | |
| 6,050,735 A | | 4/2000 | Hazzard | |
| 6,076,986 A | * | 6/2000 | Manno | 401/195 |
| 6,227,743 B1 | | 5/2001 | Robb | |
| 6,331,087 B1 | | 12/2001 | Wang | |
| 6,394,680 B1 | | 5/2002 | Poghosyan et al. | |
| 6,464,419 B1 | * | 10/2002 | Chan | 401/131 |
| 6,488,430 B1 | * | 12/2002 | Jimenez | 401/195 |

* cited by examiner

*Primary Examiner*—David J. Walczak
(74) *Attorney, Agent, or Firm*—Schweitzer Cornman Gross & Bondell LLP

(57) ABSTRACT

A multi-functional writing instrument which includes a combination pocket clip and stylus for input devices, such as personal digital assistants. The writing instrument includes a body having a cap portion, and the combination clip member and stylus having first and second ends, wherein an actuator tip is mounted to the first end and the clip member is mounted to the cap portion and pivotally movable with respect thereto. The clip member is pivotally movable relative to the instrument's body between a clamping position, for attachment to a pocket, and a stylus position, where the actuator tip is extended beyond one end of the body enabling engagement with a touch screen. The instrument allows the user to conveniently switch from writing on conventional media, for example paper, to inputting data in a personal digital assistant.

9 Claims, 2 Drawing Sheets

FIG.4
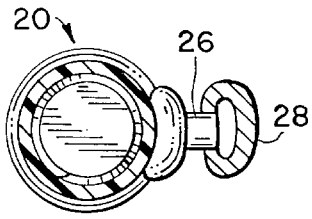
FIG.5
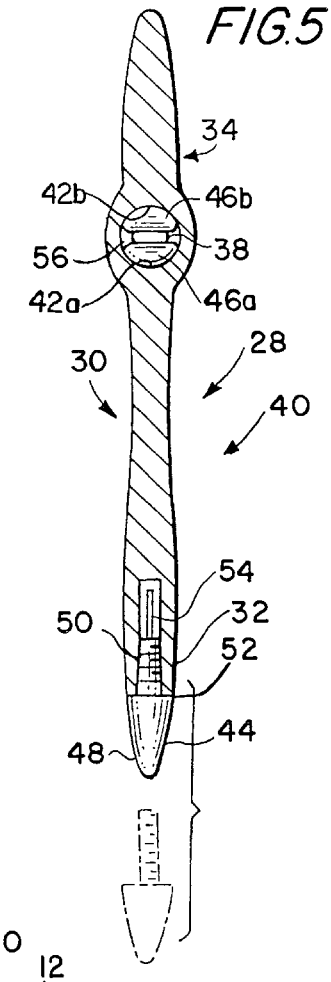
FIG.6
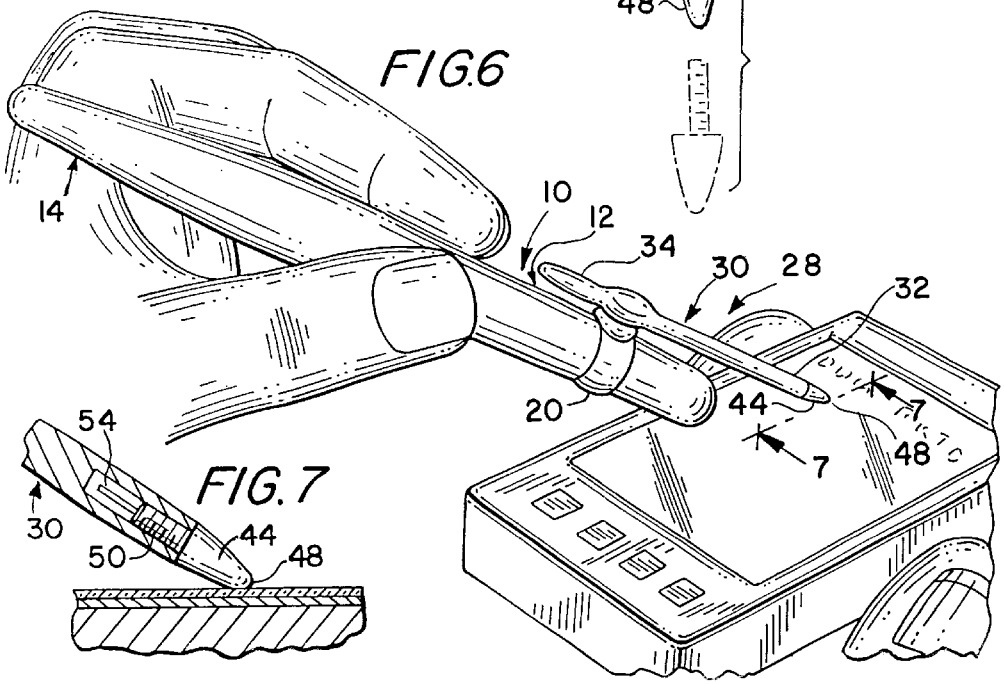
FIG.7

WRITING INSTRUMENT WITH COMBINATION POCKET CLIP AND STYLUS ASSEMBLY

FIELD OF THE INVENTION

The present invention relates to a multi-functional writing instrument, and specifically to a pen that combines a pocket clip with a stylus for entering data into devices having touch screens, such as a personal digital assistants.

BACKGROUND OF THE INVENTION

The use of personal digital assistants (PDAs) has increased in popularity over recent years due to their increasing functionality. Many PDAs can function as cellular phones, address books, personal organizers, facsimile transmitters, and most recently, as devices for wireless access to the Internet. To perform such tasks or data entry functions in connection with most PDA devices, a stylus is the principal implement used. Therefore, a readily accessible stylus is of great importance to most PDA users.

Customarily, styli are modeled after typical writing instruments; however, they resemble thinner, shorter versions thereof, and are solely functional for engaging touch-screen input devices, such as PDAs. Small sizes are required in order for styli to engage miniscule microswitches, or contact points, beneath the surfaces of PDA screens and to fit within the commonly found storage receptacles within their case enclosures. These cases, while offering users convenient places to store their styli, must maintain the compact, travel-size design of PDAs, and thereby, only allow for small, non-ergonomic styli to fit within.

Additionally, due to the design of conventional styli, they are easily misplaced, commonly unreturned to their storage receptacles, and often lost by accidental dislodging from the very compartments meant to secure them. In the event of loss and absent a keyboard for data entry, a PDA user has very few options until a replacement stylus is purchased. Although PDA users without a stylus will commonly try to enter information by tapping the display screen with their fingers or pointed objects such as pen or pencil tips, fingers, not specially shaped like styli, result in inefficient data entry. Furthermore, the use of pen or pencil tips may result in scratching or other damage to the touch screen.

To remedy such problems associated with conventional styli, including, accidental loss, the lack of holding comfort, and the absence of a multi-functional apparatus, devices which combine both the features of a writing instrument and those of a stylus have been proposed.

U.S. Pat. No. 5,564,850 to Nagaoka discloses a writing pen and stylus combination wherein the input tip for engaging a touch screen and the ink tip for writing are located at opposing extremities of the implement's cylindrical body. This implement includes only a single cap for use on the unused tip, resulting in one extremity being uncovered at all times. By placing the engagement tips at opposing extremities, and thereby protruding from the instrument's body, protective caps are necessary for both ends, as such areas are more likely to be damaged than other positions on the pen.

Similarly, U.S. Pat. No. 6,227,743 to Robb discloses a pen cap stylus in combination with a conventional writing instrument having a tip mounted to the extremity of a pen cap. However, a need still exists for a device which enhances the functionality of both the typical writing instrument, and the member that serves as a stylus. Furthermore, the need for a stylus tip that does not require protective covering still remains unmet.

An object of the present invention is to increase the functionality of traditional writing instruments and styli, while maintaining the conventional utility of both, including the ability to attach the instrument to a user's shirt pocket.

Another object of this invention is to provide a stylus that can be affixed to any type of writing instrument.

Additionally, it is an object of this invention to provide a stylus wherein the stylus is mounted other than to an extremity of a writing instrument, and thereby, not requiring a protective cap.

A further object of this invention is to facilitate the use of PDAs by allowing for their operation without a traditional stylus, while still providing a readily accessible instrument for performing such functions.

SUMMARY OF THE INVENTION

The foregoing objects are met by the present invention which includes a multi-functional writing instrument having a combination pocket clip member and stylus for touch-input devices, such as PDAs. A preferred embodiment of the writing instrument includes a body having a cap portion, and the combination clip member and stylus having first and second ends, wherein an actuator tip is mounted to the first end and the clip member is mounted to the cap portion and pivotally movable with respect thereto.

The clip member is pivotally movable relative to the pen body between a first, or clamping, position, where the clip member is positioned against the pen cap to allow for secure attachment of the pen to a shirt pocket or to hold papers between the cap and the clip member, and a second, or stylus, position, where the actuator tip of the clip member is extended beyond one end of the pen body enabling engagement with a touch screen. The instrument allows the user to conveniently switch from writing on conventional media, for example paper, to inputting data in a personal digital assistant.

A preferred embodiment for the clip member may also include an internally threaded aperture at the first end of the clip member, wherein the aperture can receive an externally threaded base of an appropriate sized removable actuator tip, capable of engaging a touch screen.

Additionally, a preferred embodiment of this invention shows the clip member mounted on a stem which projects from an annular clip holder encircling the cap portion of the instrument. However, one skilled in the art would recognize that the mounting stem could, for example, be either a component of the clip holder or be formed integrally with the pen body.

DESCRIPTION OF DRAWINGS

The above and other objects, features and advantages of the present invention will become apparent from the following description of a preferred, but nonetheless, illustrative embodiment of the invention, taken in conjunction with the accompanying drawings, wherein:

FIG. 4 is a sectional view taken along the line 4—4 in FIG. 3.

FIG. 5 is a sectional view taken along the line 5—5 in FIG. 3, depicting the inward facing side of a clip member and actuator tip.

FIG. 6 is a view showing the operation of the invention in its stylus position wherein the clip member has been pivotally rotated from its clamping position.

FIG. 7 is a view showing the actuator tip engaging the touch screen of a device, such as a PDA.

DETAILED DESCRIPTION OF THE INVENTION

Figure 1:
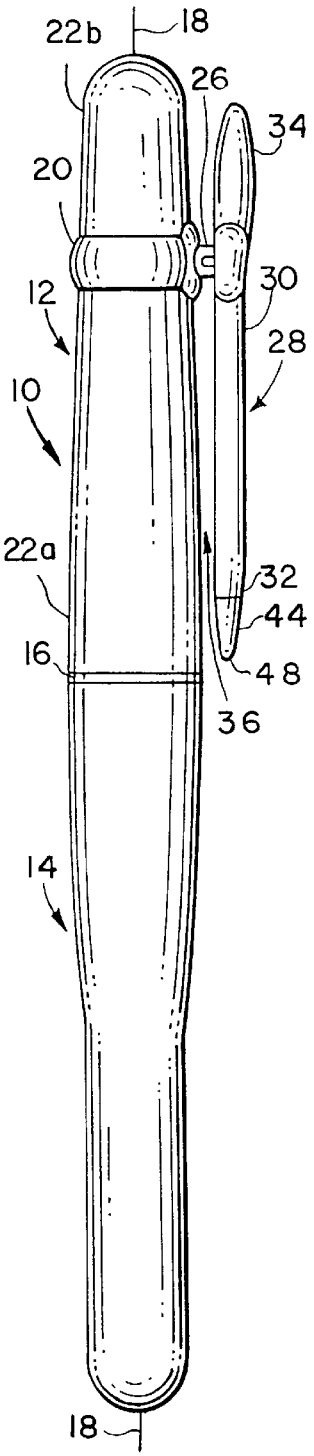
FIG. 1 is a side elevational view of the invention.
Figure 2:
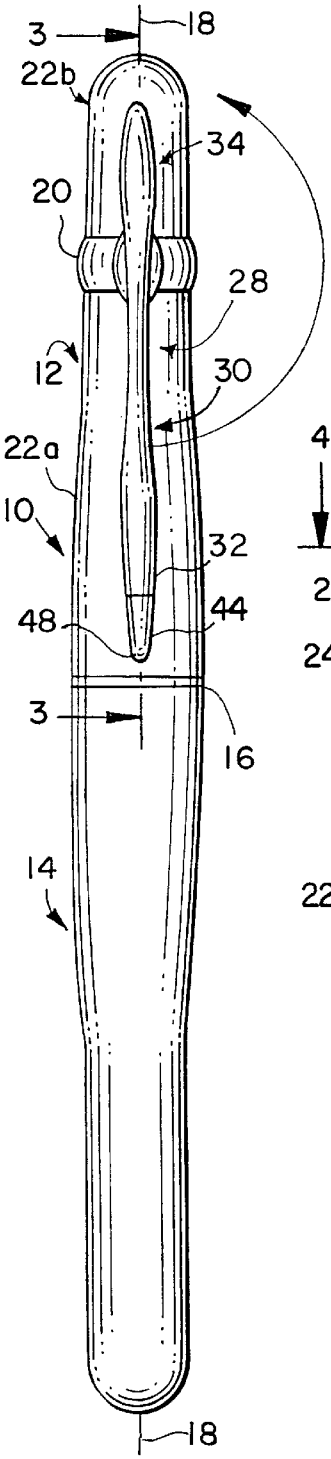
FIG. 2 is a front view of the invention in FIG. 1.

Referring to the drawings, and initially FIG. 1 and FIG. 2, a pen is shown that includes a generally tubular body 10 made in two parts, an upper, cap portion 12, and a lower, penholder portion 14 which extends into the cap portion 12 and bears a writing tip (not shown). The lower end of the cap portion 12 terminates at line 16, which in the figures shown is perpendicular with respect to the longitudinal axis 18 of the body 10.

Figure 3:
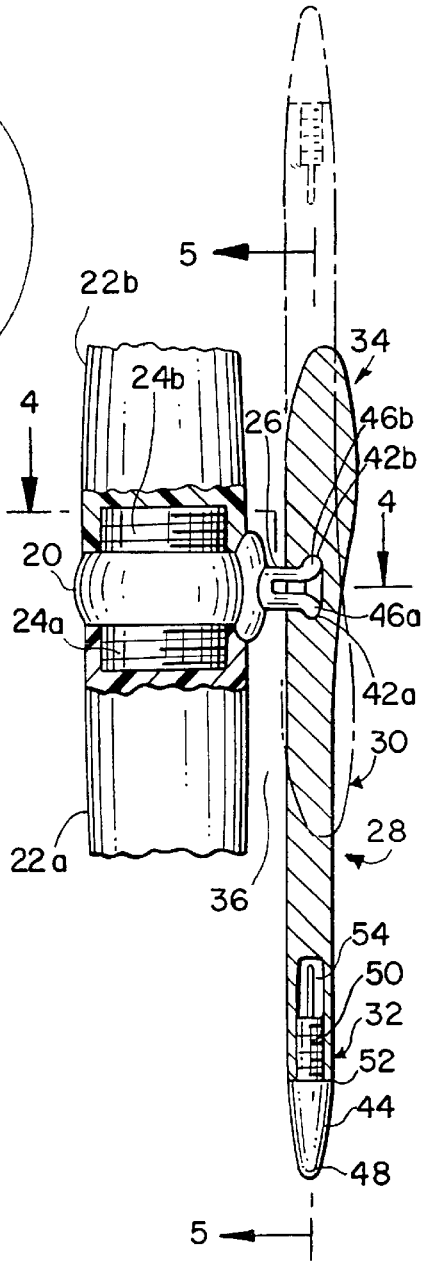
FIG. 3 is an enlarged, fragmentary sectional view taken along the line 3—3 in FIG. 2, illustrating the pivotal rotation of the clip member with respect to the body of the writing instrument.

The cap portion 12 of the body 10 bears an annular clip holder 20. This clip holder 20 may be either slidably mounted over the pen body 10 or rigidly mounted, as detailed in FIG. 3. The clip holder 20, when rigidly mounted, may be constructed to join a lower 22*a* and an upper 22*b* piece of the cap portion 12 together, wherein the clip holder 20 has two opposite projections 24*a*, 24*b*, which are accommodated within the corresponding pieces 22*a*, 22*b* of the pen cap portion 12. The pieces 22*a*, 22*b* may be threaded or frictionally fitted to receive the opposing projections 24*a*, 24*b* of the clip holder 20, as best illustrated in FIG. 3. Additionally, the particular portion of the cap portion 12, to which the clip holder 20 is affixed, may be hollow or solid depending on the particular construction of the pen and the cap portion.

The clip holder 20 further includes a stem 26 projecting outward in a perpendicular direction with respect to the longitudinal axis 18 of the body 10, which can be most easily seen in FIG. 4. The stem 26 supports an elongated clip member 28, having a main portion 30 and first and second ends 32, 34, mounted to be frictionally fitted to the stem 26.

As more specifically shown in FIG. 3, the clip member 28 is removably, pivotally mounted on the stem 26 of the clip holder 20 to be movable between first and second positions. In the first position, as shown in FIG. 1 and FIG. 2, the first end 32 of the clip member 28 is closer to the lower piece 22*a* of the cap portion 12 and displaced from the upper piece 22*b*, such that the clip member 28 can serve as a clamp wherein the area between the clip member and the body 36, coupled with the flexibility of the clip member 28, allows a portion of a garment, such as a shirt or a jacket pocket, to be gripped. When the clip member 28 is in the second position, as most clearly seen in FIG. 6 and in phantom in FIG. 3, the first end 32 of the clip member 28 is displaced from the lower piece 22*a* of the cap portion 12, extending beyond the body 10 of the pen.

To rotate the clip member 28 between first and second positions, the preferred construction of the clip member 28 includes an aperture 38 on the inward facing side 40 of the cilp's main portion 30 to receive the stem 26 on the clip holder 20. The aperture 38 includes a stopping means 42*a*, 42*b* defining end points for the pivotal movement of the clip member 28, whereby the clip member 28 may be alternatively locked in either the first or second position. Preferably, the aperture 38 includes a pair of opposed locking detents 42*a*, 42*b* to receive the stem 26. The stem 26 has two fixed stalks 46*a*, 46*b*, constructed to have such flexibility as to pass through the constricted inner portion 56 of the aperture 38 to engage the detents 42*a*, 42*b*. The engagement of the stalks 46*a*, 46*b* with the detents 42*a*, 42*b* stops the pivotal rotation of the clip member 28 in either of first or second positions, maintaining the clip member 28 in one of the alternative positions. By releasing the flxed stalks 46*a*, 46*b* from the locking detents 42*a*, 42*b*, however, the clip member 28 can be rotated 180 degrees between first and second alternative positions. Alternative constructions which utilize analogous rotating and locking mechanisms may also be employed to achieve the same result.

The clip member 28 further includes a removable actuator tip 44, wherein the actuator tip 44 is mounted to the first end 32 of the clip member 28 and serves to engage the touch screen of a PDA when the clip member 28 is in its second position. As best illustrated in FIG. 5, the actuator tip 44 includes a substantially conical head 48 and a base 50. When the clip member 28 is rotated to the second position, such that the first end 32 is displaced from the lower piece 22*a* of the cap portion 12, the conical head 48 of the actuator tip 44 is exposed from the pen body 10 to engage a touch screen, as shown in FIG. 6 and FIG. 7. To allow the actuator tip 44 to protrude beyond the body 10 of the instrument when in the second position, the length of the clip member 28 is chosen as appropriate.

As most easily seen in FIG. 5, to connect the actuator tip 44 to the clip member 28, the actuator tip 44 includes an externally threaded base 50 to allow for insertion into an internally threaded aperture 52 on first end 32 of the clip member 28. Threaded insertion of the actuator tip 44 into the aperture 52, allows for easy removal and replacement of the actuator tip 44.

The actuator tip 44 further includes a narrow elongated member 54 protruding from its base 50. The elongated member 54 is sized to fit within a miniscule aperture commonly found on PDAs (not shown) which allows the PDA to be reset upon receiving the appropriate sized member. When the actuator tip 44 is removed from the aperture 52 on the first end 32 of the clip member 28, the elongated member 54, is exposed and can be used to perform the function of resetting a PDA.

When the actuator tip 44 is mounted to the clip member 28, and the clip member 28 is rotated into the second position, the clip member 28 can be used as a stylus by pressing the actuator tip 44 against the touch screen of an input device, typically a personal digital assistant as shown in FIG. 6 and FIG. 7. Preferably, when the clip member 28 is no longer in use as a stylus, it is rotated into the first position to function as a clamp, protecting the actuator tip 44 from damage. Therefore, this invention allows the user to conveniently switch between using the instrument as a pen or a stylus, increases the functionality of the clip and stylus attachment, and eliminates undesirable elements which were necessary in the prior art.

While the invention has been described with reference to a preferred embodiment thereof, it should be understood that many modifications or variations may be made without departing from the spirit and scope of this invention. For instance, although the preferred embodiment is of the same or similar size as a typical writing instrument, this invention is not limited to that size, nor is it limited to any specific type of instrument. The invention relates to any writing instrument, such as a fountain pen, ballpoint pen, mechanical pencil, felt-tip pen, marker, highlighter, or similar article having a body, wherein a clip member having an actuator tip is movably mounted thereto. Additionally, the pen body need not be tubular in shape, nor the tip substantially conical for this invention to operate in the same manner. It is also apparent that the "body" of a writing instrument in the context of this invention, may be either the writing instrument itself or a detachable cap. Furthermore, the clip member may be mounted on a writing implement in various ways. For aesthetic and functional purposes, it is desirable to have a clip holder that is securely affixed to the instrument's body to mount the clip thereon. However, a clip may be mounted on an unaffixed holder that merely slides over the body of the instrument. For the above reasons, the scope of this invention is to be defined by the appended claims.

What is claimed is:

1. A writing instrument comprising:

a body having two ends and a longitudinal axis;

a clip member movably mounted to said body, whereby said clip member is capable of being pivotally rotated in a radial direction in a plane parallel to and spaced from said longitudinal axis between a first position wherein said clip member functions as a clamping element and a second position wherein said clip member functions as a stylus; and a stopping means defining end points for the pivotal movement of said clip member, said end points comprising said first and said second positions.

2. The writing instrument as set forth in claim 1, wherein said stopping means includes a pair of locking detents, positioned to alternatively lock said clip member in either said first or said second position.

3. The writing instrument as set forth in claim 1, further comprising an actuator tip mounted to said clip member.

4. The writing instrument as set forth in claim 3, wherein said clip member is of a sufficient length to expose said actuator tip beyond said body when pivotally rotated into said second position for functioning as a stylus.

5. The writing instrument as set forth in claim 3, wherein said actuator tip includes a head and a base, wherein said head is substantially conical.

6. The writing instrument as set forth in claim 5, wherein said base is externally threaded having a narrow portion of a predetermined length protruding therefrom, said narrow member sized to fit within a resetting aperture on an input device.

7. The writing instrument as set forth in claim 6, wherein said clip member includes a main portion, first and second ends, and an aperture housing said stopping means, said first end having an internally threaded aperture for receiving said externally threaded base of said actuator tip.

8. The writing instrument as set forth in claim 7, wherein said clip member is mounted to a clip holder, said clip holder mounted to said body.

9. The writing instrument as set forth in claim 8, wherein said clip holder includes a mounting stem, said mounting stem received into said aperture of said clip member.

* * * * *